United States Patent [19]

Adams, III

[11] Patent Number: 4,773,881

[45] Date of Patent: Sep. 27, 1988

[54] KEYING SYSTEM FOR CONNECTOR ASSEMBLIES

[75] Inventor: Charles N. Adams, III, Harrisburg, Pa.

[73] Assignee: AMP Incorporated, Harrisburg, Pa.

[21] Appl. No.: 158,091

[22] Filed: Feb. 16, 1988

Related U.S. Application Data

[63] Continuation of Ser. No. 052,807, May 21, 1987, abandoned.

[51] Int. Cl.[4] ..... H01R 13/64

[52] U.S. Cl. ..... 439/681; 29/631

[58] Field of Search ..... 439/374, 677–681; 29/631

[56] References Cited

U.S. PATENT DOCUMENTS

| | | | |
|---|---|---|---|
| 3,200,361 | 8/1965 | Schwartz et al. | 439/681 |
| 4,178,051 | 12/1979 | Kocher et al. | 339/45 M |
| 4,243,288 | 1/1981 | Lucius et al. | 339/99 R |
| 4,376,565 | 3/1983 | Bird et al. | 339/186 M |
| 4,448,467 | 5/1984 | Weidler | 339/17 LC |
| 4,448,471 | 5/1984 | Berry et al. | 339/91 R |
| 4,449,767 | 5/1984 | Weidler | 339/17 LC |
| 4,580,868 | 4/1986 | Verstijnen | 339/186 M |

FOREIGN PATENT DOCUMENTS

| | | |
|---|---|---|
| 2021547 | 11/1971 | Fed. Rep. of Germany . |
| 3331792 | 3/1985 | Fed. Rep. of Germany . |
| 1568189 | 5/1980 | United Kingdom . |

OTHER PUBLICATIONS

AMP Inc. Engineering & Purchasing Guide 5th edition, catalog No. 4507-1 1984; pp. C-475, C-481, C-504, C-232, C-233, C-234, B-333, B-340, C-429, and C-432.

*Primary Examiner*—J. Patrick McQuade

*Attorney, Agent, or Firm*—Gerald K. Kita

[57] ABSTRACT

A keying system 9 for connector assemblies 1,8 comprises, individual keying means 30,31,32,33 of one of the connector assemblies 8 directly opposing individual keying means 10,11,12,13 of the connector assembly 1, either one of the other of said directly opposing individual keying means 30,10; 31,11; 32,12; 33,13 is removed, and a vacancy remaining from a removed individual keying means is occupied with the nonremoved individual keying means upon orientation of the connector assemblies 1,8 in corresponding predeterminate positions with respect to each other.

4 Claims, 3 Drawing Sheets

KEYING SYSTEM FOR CONNECTOR ASSEMBLIES

This application is a continuation of application Ser. No. 052,807 filed May 21, 1987, now abandoned.

FIELD OF THE INVENTION

The invention relates to a keying system for permitting mating together of connector assemblies in corresponding predeterminate positions with respect to one another, and particularly to a keying system constructed for producing a variety of keying combinations from which a particular keying combination is selected.

BACKGROUND OF THE INVENTION

A suitable keying system for mating pairs of the connector assemblies will permit mating together of the connector assemblies in corresponding predeterminate positions with respect to one another. The suitable keying system further will produce a variety of keying combinations from which a particular keying combination is selected and then applied to the pair of connector assemblies. The suitable keying system will prevent mating together of connector assemblies not having the same keying combination.

A keying system disclosed in West German Patent No. 2 021 547 includes break away portions providing a pattern of openings in a first connector assembly, and keys attached to a second connector assembly to fit only the pattern of openings.

A keying system disclosed in U.S. Pat. No. 4,376,565 includes break away portions providing slots in a first connector assembly and opposing grooves in a second connector assembly. A key is added to either one or the other of an opposing slot or groove to provide a selected keying combination.

Each prior keying system requires assembly of separate keys to corresponding connector assemblies. A disadvantage may arise that the separate keys are absent at a time when the connector assemblies are ready for installation as a mated pair. Accordingly, a need exists for a keying system capable of varied keying combinations and constructed directly on corresponding connector assemblies for providing a selected keying combination available at a time when the corresponding connector assemblies are intended as a mated pair.

In each described prior keying system, the keys are loose parts that are subject to erroneous assembly, or subject to undesired separation from the corresponding connector assemblies. A need exists for a keying system that provides a variety of keying combinations, from which a particular keying combination can be selected, and a keying system without separate parts to be assembled on connector assemblies.

SUMMARY OF THE INVENTION

An aspect of the invention is directed to an improved keying system formed during manufacture directly on corresponding connector assemblies and providing a variety of keying combinations from which a keying combination is selected.

An aspect of the invention is directed to an improved method of selecting a keying combination from a variety of keying combinations provided by a keying system formed during manufacture directly on corresponding connector assemblies.

An aspect of the invention is directed to an improved keying system of individual keying means of one connector assembly directly opposing corresponding individual keying means of another connector assembly, one or the other of said directly opposing individual keying means is removed, and a vacancy remaining from a removed individual keying means is occupied by the nonremoved and directly opposing individual keying means upon orientation of the connector assemblies in corresponding predeterminate positions with respect to each other.

Another aspect of the invention resides in a keying system for connector assemblies in which one of the connector assemblies has opposite sides and is provided with removable individual keying means arranged in a first pattern on one side and a second pattern on the other side, and the other of the connector assemblies has opposite sides and is provided with removable individual keying means arranged in a repeated first pattern and a repeated second pattern on each of the opposite sides, and either the repeated first pattern or the repeated second pattern is removed to select a keying combination of the individual keying means of one connector opposing the individual keying means of the other connector.

OBJECTS OF THE INVENTION

An object of the invention is to provide an improved keying system formed during manufacture directly on corresponding connector assemblies and providing a variety of keying combinations from which a keying combination is selected.

Another object of the invention is to provide an improved method of selecting a keying combination from a variety of keying combinations provided by a keying system formed during manufacture directly on corresponding connector assemblies.

Another object of the invention is to provide an improved keying system from which a keying combination is selected for permitting mating together of connector assemblies in corresponding predeterminate positions with respect to one another and for preventing mating together of connector assemblies not having the same keying combination.

Another object of the invention is to provide an improved keying system for connector assemblies in which one of the connector assemblies is provided with individual keying means directly opposing individual keying means of another of the connector assemblies, either one or the other of said directly opposing individual keying means is removed to provide a keying combination, and a vacancy remaining from a removed individual keying means is occupied by a nonremoved and directly opposing individual keying means upon orientation of the connector assemblies in corresponding predeterminate positions with respect to each other.

Another object of the invention is to provide an improved keying system in which one of the connector assemblies has opposite sides and is provided with removable individual keying means arranged in a first pattern on one side and a second pattern on the other side, and the other of the connector assemblies has opposite sides and is provided with removable individual keying means arranged in a repeated first pattern and a repeated second pattern on each of the opposite sides, and either the repeated first pattern or the repeated second pattern is removed to select a keying combination of the individual keying means of one connector opposing the individual keying means of the other connector.

The above described advantages of the invention are apparent from a detailed description that follows and from accompanying drawings wherein;

DETAILED DESCRIPTION

Figure 1:
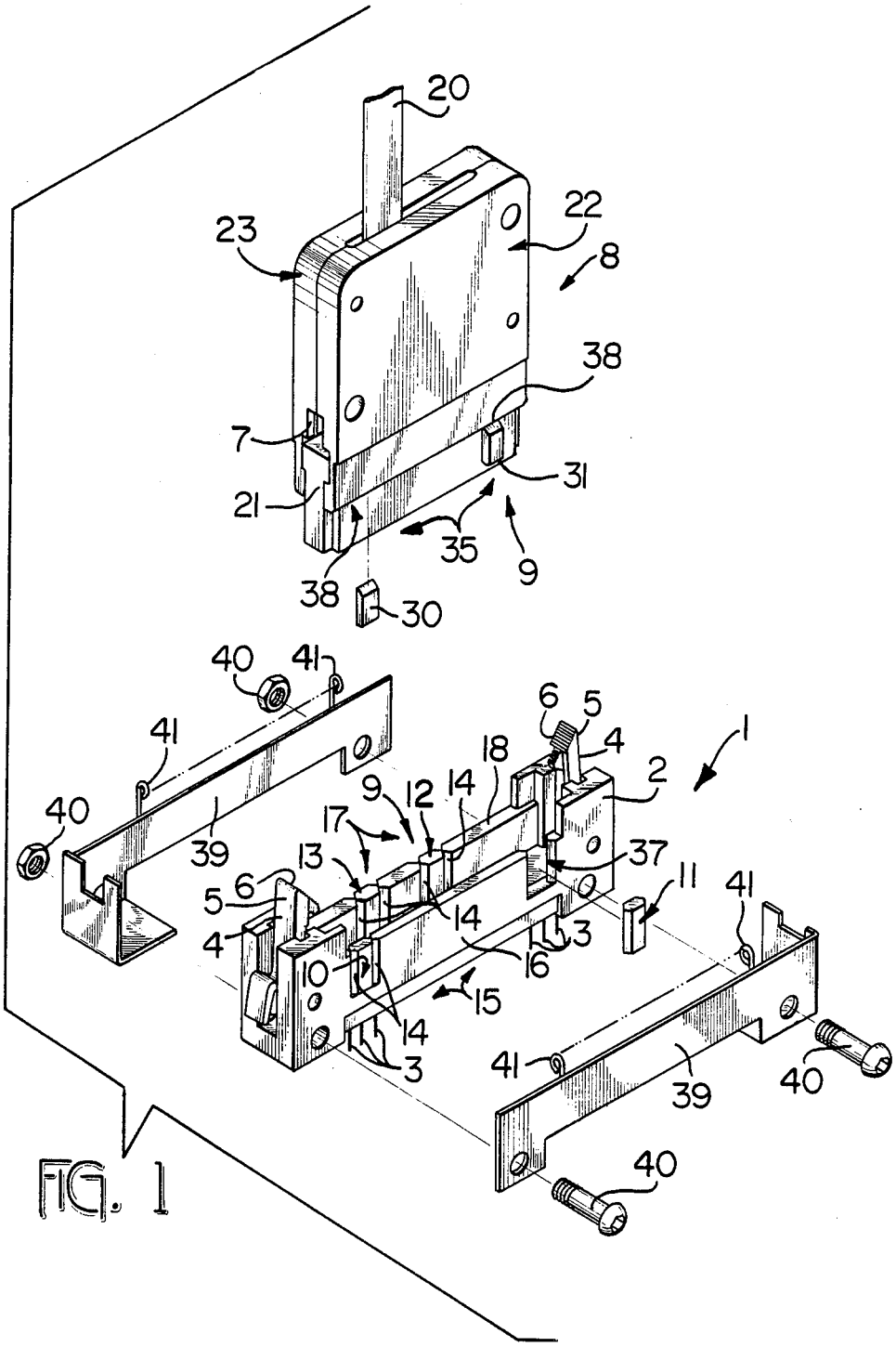
FIG. 1 is a fragmentary perspective view of a keying system directly on corresponding connector assemblies, with conductive grounding clips for the connector assemblies, and with parts illustrated in exploded configuration.

With more particular reference to FIG. 1 of the drawings, a first connector assembly 1 is shown and includes an insulative housing 2 containing rows of conductive pins 3. The pins 3 project from the housing 2 for connection into corresponding apertures of a printed circuit board, not shown. The first connector assembly 1 includes a pair of eject mechanisms 4,4 having latch arms 5,5. Projections 6,6 on the latch arms register within corresponding openings 7,7, one of which is shown in a second connector assembly 8 constructed for mating with the first connector assembly 1.

The construction of the connector assemblies 1,8 is disclosed in further detail by U.S. Pat. Nos. 4,448,471 and 4,178,051. The connector assemblies 1,8 are constructed as disclosed by the Patents, and are further constructed with a keying system 9 the details of which are disclosed below.

The first connector assembly 1 is provided with keying means 10,11,12,13 forming keyway sections and being manufactured as parts of the first connector assembly 1. For example, the keying means 10,11,12,13 are integral parts of the insulative housing 2 and are formed during manufacture of the insulative housing 2 by known plastics forming techniques. Each keying means 10,11,12,13 is a keyway section and include integral webs 14,14 of thin wall insulative material joined to the insulative housing. For example, individual keying means 10,11 are arranged in a first pattern 15 on a first side 16 of the first connector assembly 1, and individual keying means 12,13 are arranged in a second pattern 17 on a second side 18 of the first connector assembly 1. The first pattern 15 is defined by the number of individual keying means 10,11 and the spacing separating the individual keying means 10,11 along the corresponding side 16 of the housing 2 of the first connector assembly 1. The second pattern 17 is different from the first pattern 15 and is defined by the number of individual keying means 12,13 and the spacing separating the individual keying means 12,13 along the corresponding side 18 of the housing 2.

Figure 4:
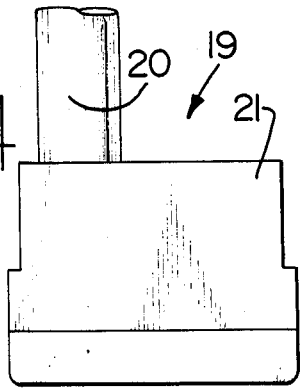
FIG. 4 is an elevation view of an electrical cable and an electrical connector assembled to the cable.

As shown in FIG. 4, the second connector assembly 8 includes a cable assembly 19. For example, the cable assembly 19 may comprise an electrical cable 20 connected to an electrical connector 21. For illustration purposes, the axis of the cable 20 is offset from the axis of the connector 21. Further details of the cable assembly 19 are disclosed in U.S. Pat. No. 4,243,288. The cable assembly 19 may comprise, for example, the cable 20 connected to a circuit board (not shown) instead of being connected to the connector 21. The second connector assembly 8 also includes a first cover plate 22 forming a first side 22 of the second connector assembly 8 and a second cover plate 23 forming a second side 23 of the second connector assembly 8. The cover plates 22,23 are assembled to each other and are constructed to enclose the cable assembly 19 to the extent as shown in FIG. 1.

Figure 2:
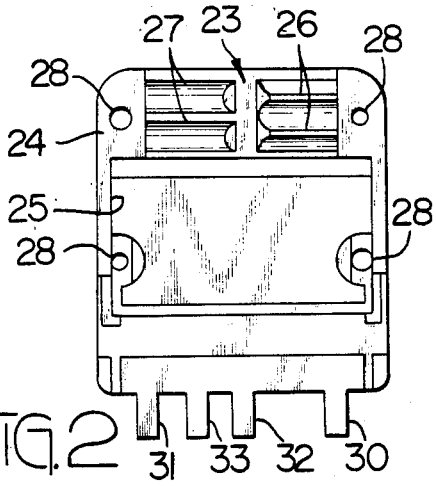
FIG. 2 is an elevation view of an interior of a first side of a connector assembly having individual keying means.
Figure 5:
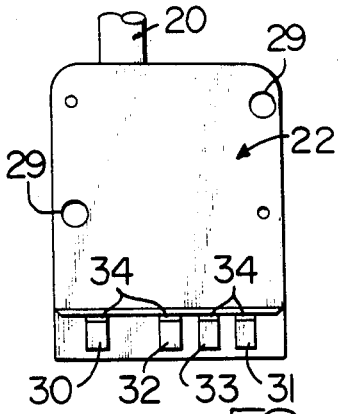
FIG. 5 is an elevation view of a connector assembly fabricated from the parts shown in FIGS. 2, 3, and 4.
Figure 3:
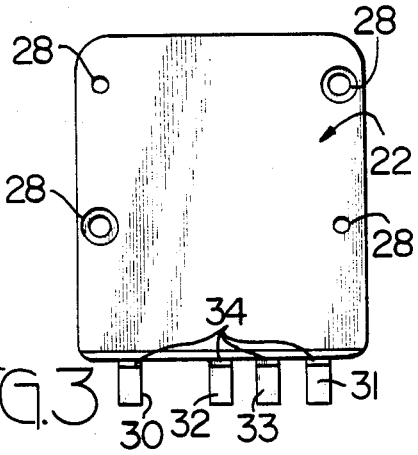
FIG. 3 is an elevation view of an exterior of a second side of a connector assembly having individual keying means.

The cover plates 22,23 are replicas of each other, and are described as follows. Each cover plate 22,23 has an interior 24, shown in FIG. 2, provided with a recess 25 shaped to nest with the exterior of the connector 21 when the corresponding cover plate 22,23 is assembled over the cable assembly 19. The interior 24 of each cover plate 22,23 is further provided with spaced apart and projecting ribs 26,26 constructed to extend transversely of the cable 20 and to impinge against the cable 20 when the corresponding cover plate 22,23 is assembled over the cable assembly 19. The interior 24 of each cover plate 22,23 is further provided with spaced apart recesses 27,27. When the cover plates 22,23 are assembled over the cable assembly 19, the cable 20 may be interposed between the ribs 26,26 of a corresponding cover plate 23 and the recesses 27,27 of the opposite corresponding cover plate 22. The ribs 26,26 are opposite the corresponding recesses 27,27 and impinge against the cable 20 to press the cable 20 partially into the recesses 27,27. Thereby the cover plates 22,23 clamp the cable 20 and provide a cable strain relief that resists separation of the cable 20 from the connector 19 as the result of a tensile force on the cable 20. Each cover plate 22,23 includes fastener receiving apertures 28,28,28,28 into which self threading fasteners 29,29,29,29 are driven to secure the cover plates 22,23 together. Each cover plate 22,23 is covered with a conductive metal coating applied, for example, according to known techniques of applying plated metal on plastics material. A further advantage results from saving design and manufacturing costs, since both cover plates 22,23 are made as replicas of the same part.

The second connector assembly 8 is provided with keying means 30,31,32,33 manufactured as parts of the second connector assembly 8. For example, the keying means 30,31,32,33 are integral parts of the cover plates 22,23 and are formed during manufacture of the cover plates 22,23 by known plastics forming techniques. Each keying means 30,31,32,33 comprises a projecting key that includes an integral web 34 of thin wall insulative material joined the the corresponding cover plate 22,23. The individual keying means 30,31 are arranged in a repeated first pattern 35, shown in FIG. 6, and the individual keying means 32,33 are arranged in a repeated second pattern 36, shown in FIG. 7, that is within and bounded by the repeated first pattern 35.

According to practice of the following method, a first keying combination is selected to provide polarity of the second connector assembly 8 with respect to the first connector assembly 1. For example, each side 22,23 of the second connector assembly 18 has removable individual keying means 30,31,32,33 arranged in a repeated first pattern 35 and a repeated second pattern 36. Either the repeated first pattern 35 or the repeated second pattern 36 is determined to be redundant and is removed, thereby to select a first keying combination of each nonremoved individual keying means 30,31,32,33 of the second connector assembly 8 opposing a corresponding individual keying means 10,11,12,13 of the first connector assembly 1.

The first keying combination will result in each nonremoved individual keying means 30,31 of the repeated first pattern 35 opposing a corresponding nonremoved individual keying means 10,11 of the first pattern 15, and each nonremoved individual keying means 32,33 of the repeated second pattern 36 opposing a corresponding nonremoved individual keying means 12,13 of the second pattern 17.

Figure 6:
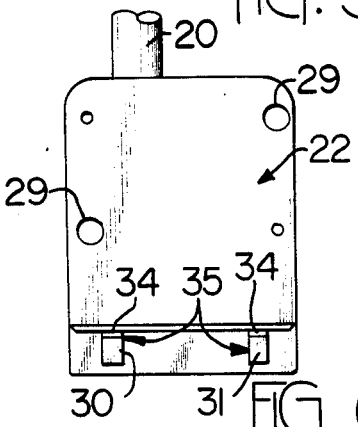
FIG. 6 is an elevation view of one side of the connector assembly shown in FIG. 5 with a pattern of individual keying means.
Figure 7:
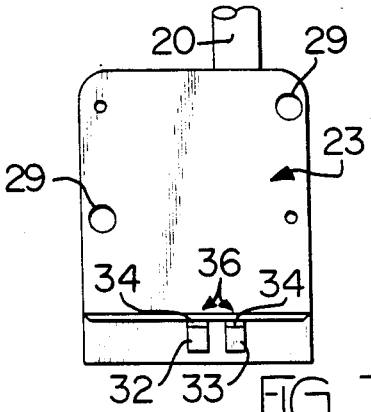
FIG. 7 is an elevation view of another side of the connector assembly shown in FIG. 5 with a pattern of individual keying means different from the pattern on the one side shown in FIG. 6.

As shown in FIG. 6, the first side 22 of the second connector assembly 8 is provided with nonremoved individual keying means 30,31 arranged in the repeated first pattern 35, after removal of the redundant keying means 32,33 of the repeated second pattern 36. The first side 22 is matched for polarity with the corresponding first side 16 of the first connector assembly 1 having the corresponding first pattern 15 of individual keying means 10,11. As shown in FIG. 7, the second side 23 of the second connector assembly 8 is provided with nonremoved individual keying means 32,33 arranged in the repeated second pattern 36, after removal of the redundant keying means 30,31 of the repeated first pattern 35. The second side 23 is matched for polarity with the corresponding second side 18 of the first connector assembly 1 having the corresponding second pattern 17 of individual keying means 12,13.

According to practice of the following method, the connector assemblies 1,8 are provided with a further keying combination to permit mating together of only the connector assemblies 1,8 having the same keying combination. The connector assemblies 1,8 are first provided with the first keying combination wherein each nonremoved individual keying means 30,31,32,33 of the second connector assembly 8 is opposing a corresponding nonremoved individual keying means 10,11,12,13 of the first connector assembly 1. To provide the further keying combination, either one or the other of the opposing individual keying means 30,10; 31,11; 32,12; 33,13 is removed.

Figure 8:
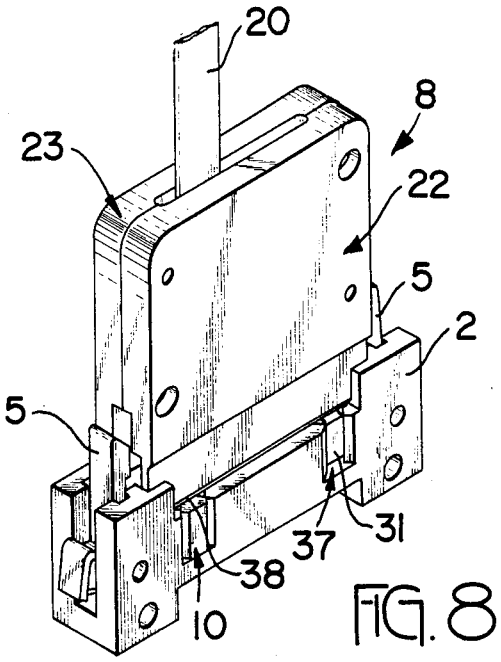
FIG. 8 is a fragmentary perspective view of the connector assemblies shown in FIG. 1 and mated together without illustration of the conductive clips.
Figure 9:
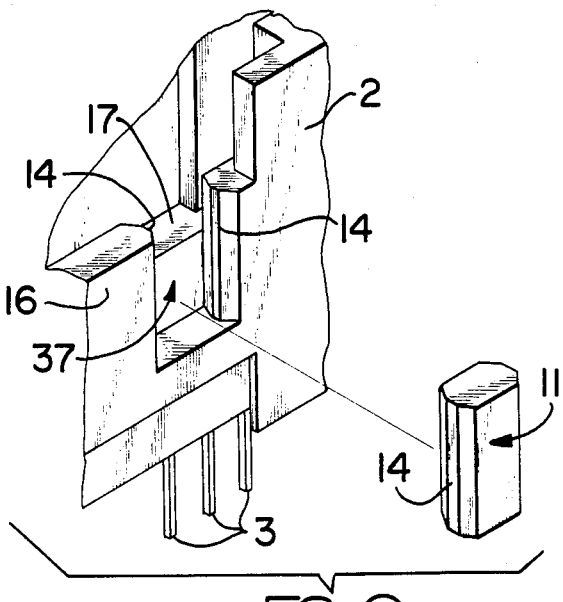
FIG. 9 is a fragmentary enlarged perspective view of a portion of a connector assembly shown in FIG. 1.

As shown in FIGS. 1 and 8, a further keying combination is achieved by removing one or the other in each pair 30,10; 31,11 of the directly opposed individual keying means of the first pattern 16 and of the repeated first pattern 35. For example, the individual keying means 11 of the first connector assembly 1 is removed, leaving a vacancy, for example, in the form of a keyway 37, to be occupied by the nonremoved and directly opposed individual keying means 37 of the second connector assembly 8. Removal of any one of the keyway sections 10,11,13,14 will leave a corresponding vacancy 37 in the form of a keyway 37. Further for example, the individual keying means 30 of the second connector assembly 8 is removed, leaving a vacancy 38 for example, a space 38 to be occupied by the nonremoved and directly opposed keying means 10 of the first connector assembly 1.

By practice of a similar procedure, a further keying combination is achieved by removing one or the other of each pair 32,12; 33,13 of directly opposed individual keying means of the second pattern 17 and of the repeated second pattern 36. A selected keying combination is obtained from many possible combinations by selecting which one of the individual keying means is removed from each pair 30,10; 31,11; 32,12; 33,13 of directly opposed individual keying means.

A selected keying means 10,11,12,13,30,31,32,33 is separated from the corresponding connector assemblies 1,8 by cutting or breaking the corresponding web protions 14,34. Each removed keying means will leave a severed edge of 14 or 34 as a remnant of the removed keying means on the corresponding connector assembly 1,8.

A vacancy, for example, the vacancy 37,38, resulting from removal of an individual keying means 10,11,12,13,30,31,32,33 is occupied by a nonremoved and directly opposing individual keying means , for example, the keying means 30,10 when the connector assemblies 1,8 are oriented in predeterminate positions with respect to one another, and are mated together as shown in FIG. 8. As shown in FIG. 1, a pair of conductive grounding clips 39,39 for connection to ground electrical potentials are applied over the corresponding sides 16,18 of the first connector assembly 1 and are secured by nuts and bolts type fasteners 40. Resilient fingers 41,41 project from the grounding clips to engage the corresponding sides 22,23 of the cover plates 22,27 and establish electrical connections with the conductive coating of the cover plates 22,23.

The invention disclosed in conjunction with the above described embodiment is intended to be covered by the spirit and scope of the appended claims extended to modifications and variations of the above described embodiment.

I claim:

1. In a keying system for two connector assemblies, a first of the connector assemblies includes a plurality of first keying elements along a first side and a plurality of second keying elements along a second side, the spacing apart of the first keying elements is unequal to the spacing apart of the second keying elements, and a second of the connector assemblies is constructed of side portions, each of the side portions having removable projecting keying means, the improvement comprising;

the side portions are duplicates of each other with all the keying means on each one of said side portions being equal in number to the sum of all the first keying elements and all the second keying elements, the keying means on each one of said side portions comprising, a first plurality of removable projecting keying elements with a spacing apart corresponding to the spacing apart of the first keying elements, and a second plurality of removable projecting keying elements with a spacing apart corresponding to the spacing apart of the second keying elements, the first plurality is removable from a first of said side portions while the second plurality remains on the first of said side portions for directly opposing the second keying elements and providing parts of directly opposing keying elements, the second plurality is removable from a second of said side portions while the first plurality remains on the second of said side portions for directly opposing the first keying elements and providing pairs of directly opposed keying elements, and an individual keying element of each pair of directly opposing keying elements is selectively removable to permit mating together of the connector assemblies.

2. In a keying system as recited in claim 1, the improvement further comprising;

the keying elements of the first connector assembly comprises removable keyway sections, and the keying elements of the second connector assembly comprises projecting keys.

3. In a keying system as recited in claim 1, the improvement further comprising;

a keyway in each said side of the first connector assembly is provided by removal of a corresponding keying element, and each said keyway receives a corresponding keying element of the second connector assembly upon mating together of the connector assemblies.

4. A method for selecting a keying combination of keying elements to permit mating together of a first connector assembly and a second connector assembly, wherein the first connector assembly includes a plurality of first keying elements along a first side and a plurality of second keying elements along a second side, the spacing apart of the first keying elements is unequal to the spacing apart of the second keying elements, and the second connector assembly is constructed of side portions, each of the side portions having removable projecting keying means, the improvement comprising the steps of;

forming the side portions as duplicates of each other with all the keying means on each one of said side portions being equal in number to the sum of all the first keying elements and all the second keying elements, forming the keying means on each one of said side portions as, a first plurality of removable projecting keying elements with a spacing apart corresponding to the spacing apart of the first keying elements, and a second plurality of removable projecting keying elements with a spacing apart corresponding to the spacing apart of the second keying elements, removing the first plurality from a first of said side portions while the second plurality remains on the first of said side portions for directly opposing the second keying elements and providing pairs of directly opposing keying elements, removing the second plurality from a second of said side portions while the first plurality remains on the second of said side portions for directly opposing the first keying elements and providing pairs of directly opposed keying elements, and selectively removing an individual keying element of each pair of directly opposing keying elements to permit mating together of the connector assemblies

* * * * *